United States Patent [19]

Daumann

[11] 3,939,583

[45] Feb. 24, 1976

[54] ICE HOCKEY BOOT

[75] Inventor: Oskar Paul Daumann, Schney, Germany

[73] Assignee: LICO-Sportschuhfabriken Link & Co., GmbH, Schney, Germany

[22] Filed: Oct. 2, 1974

[21] Appl. No.: 511,319

[30] Foreign Application Priority Data

Oct. 2, 1973 Germany ..... 7335607[U]

[52] U.S. Cl. ..... 36/2.5 R; 280/11.3

[51] Int. Cl.[2] ..... A43B 00/00; A63C 1/02

[58] Field of Search ..... 36/2.5 R, 2.5 AL; 280/11.1 R, 11.12, 11.13 A, 11.13 W, 11.18 11.3

[56] References Cited

UNITED STATES PATENTS

| | | | |
|---|---|---|---|
| 1,597,108 | 8/1926 | Planert | 280/11.3 |
| 3,377,721 | 4/1968 | Johnson | 36/2.5 AL |
| 3,609,887 | 10/1971 | Hickmann et al. | 36/2.5 AL |
| 3,823,493 | 7/1974 | Brehm et al. | 36/2.5 R |

FOREIGN PATENTS OR APPLICATIONS

| | | | |
|---|---|---|---|
| 675,614 | 7/1952 | United Kingdom | 280/11.3 |

*Primary Examiner*—Patrick D. Lawson
*Attorney, Agent, or Firm*—Craig & Antonelli

[57] ABSTRACT

This invention relates to an ice hockey shoe with an outer shell of a relatively hard synthetic resin and an inner shoe made of a relatively soft synthetic resin, and with a blade support attached to the outer sole.

12 Claims, 4 Drawing Figures

ICE HOCKEY BOOT

BRIEF SUMMARY OF THE INVENTION

The production of a shoe shank with the use of a relatively hard and rugged synthetic resin is of special advantage in all those cases where there is a need for a firm hold of the foot in the shoe, a protection of the foot from external influences and/or a special wear resistance of the shoe shank. In the areas close to the ski boot art, a large number of designs have become known wherein the outer shell is, in all cases, fashioned so that it follows the outline of the foot only extremely vaguely. The adaptation to the shape of the individual parts of the foot is accomplished by the inner shoe arranged between the foot and the inner wall of the outer shell and/or by more or less firm filler materials disposed between the outer wall of the inner shoe and the inner wall of the outer shell. This requires disadvantageously a relatively high expenditure in material and thus additional weight; the hold of the foot with respect to the outer shell is not at an optimum and/or must be established by lever-transmitted locks whereby the shank in the locking zone exerts considerable pressure on the foot, leading to disturbances in blood circulation. In order to permit a foot movement promoting circulation, inter alia, multipartite shank arrangements have been suggested which, in addition to other disadvantages, causes the shank to be more expensive.

The present invention is to provide an ice hockey boot of the type mentioned in the foregoing which ensures, with a low weight and low expenditure in material, a maximally firm hold of the boot at the foot.

This object is attained, according to this invention, by providing that the outer shell is fashioned in adaptation to the configuration of the foot in the joint zone, in the ankle zone, and in the heel zone, especially with regard to the recess above the heel region in the zone of the Achilles tendon, and is made of one piece.

By the adaptation of the shape of the outer shell to the contour of the foot form in the aforementioned zones, the foot receives a particularly good hold, since already the outer shell rests without displacement on the bulges and recesses of the foot in the closed condition. The inner shoe can be fashioned with a wall thickness which is the same almost throughout; only in especially sensitive areas, a somewhat thicker wall can be chosen for padding purposes. In a particularly preferred embodiment, the inner shoe of the arrangement is also adapted to the shape of the foot in the joint region, in the ankle zone, and in the heel zone, especially with respect to the constriction above the heel zone in the region of the Achilles tendon.

Another preferred embodiment provides that the outer shell is fashioned with a decreasing wall thickness toward the marginal regions — especially toward the edge zones of the opening for the top of the foot. In this area of the edge of the opening for the top of the foot, the outer shell is preferably provided with perforations to receive shoelaces. Furthermore, the outer shell can have openings for shoelaces in the shank-protecting portion which is extended above the Achilles tendon zone.

In an especially preferred embodiment of this invention, the sole zone of the outer shell is fashioned to be reinforced, especially thickened, so that the blade support is attached exclusively to this reinforced sole region, especially by means of rivets.

A tongue arranged between the outer shell and the inner shoe is preferably formed integrally at the inner shoe and extends, in the condition ready for use, from the outside over the zones of the inner shoe covering the top foot surface. Thus, the tongue advantageously consists of the softer material used for the inner shoe and serves as a padding with respect to the lacing. For this purpose, the tongue can have a thicker wall as compared to the transition zone to the shank, in the region of the top surface of the foot (dorsum pedis). Due to the feature that the zones of the inner shoe covering the top surface of the foot extend along their edges toward the outside, any moisture entering through the top opening of the outer shell does not penetrate to the interior of the inner shoe.

In a further preferred embodiment, the inner shoe is covered by a fabric on the inside. Preferably, a lining for the foot is incorporated into the inner shoe.

BRIEF DESCRIPTION OF THE DRAWINGS

The invention will be explained in greater detail below with reference to the example illustrated in the drawings, to wit.

DETAILED DESCRIPTION OF THE DRAWINGS

Figure 1:
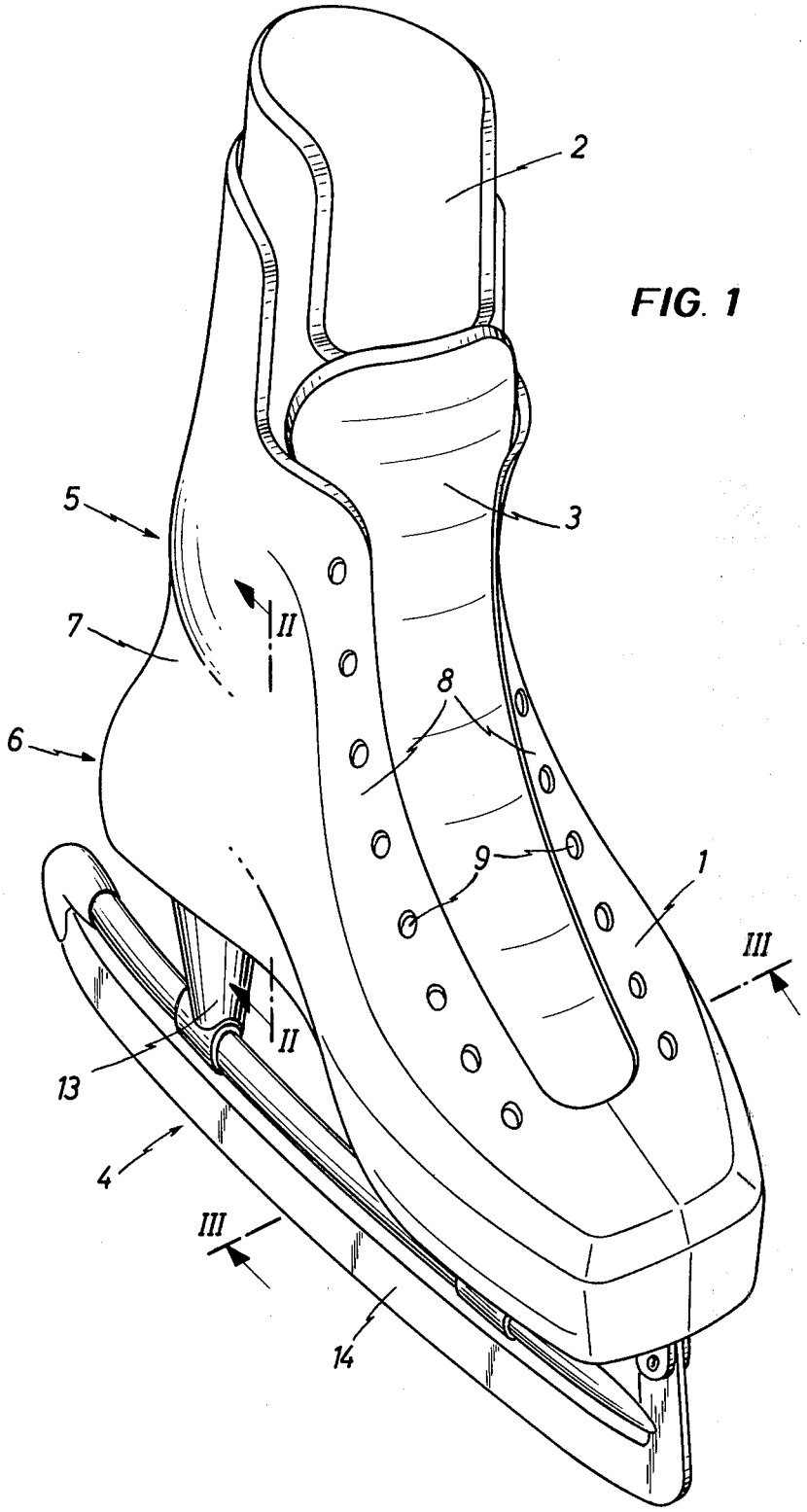
FIG. 1 shows a perspective view of an ice hockey boot constructed in accordance with a preferred embodiment of the invention.

The embodiment of the invention shown in the drawing is provided with an integrally molded, preferably injection-molded, outer shell 1 into which is inserted a likewise integrally formed inner shoe 2. The inner shoe 2 is provided with a tongue 3 which — as can be seen from FIG. 1 — extends with its lateral zones between the associated edge zones of the outer shell and the inner shoe at the opening for the top of the foot.

The inner shoe 2 and the outer shell 1 are also fashioned so that they are adapted to the shape of the foot in individual regions, such as the joint zone 4, the ankle zone 5, and the heel zone 6, as well as the zone of the Achilles tendon, denoted by 7. Thus, also the outer shell follows the contour of the foot in this area and accordingly ensures a good fit of the shoe on the foot without it being necessary for the inner shoe 2 to effect the adaptation between the outer shell and the foot. Therefore, the inner shoe can be fashioned in total with an approximately uniform wall thickness, making it possible to provide a padding which remains the same over the entire shank region. This padding can be thin-walled, because due to the adapted configuration of the outer shell there are no localized zones of increased pressure. Only in those areas where, because of a special sensitivity of the foot, a thicker padding is desirable, as in the zone of the Achilles tendon, the wall thickness of the inner shoe shank can be chosen to be somewhat thicker.

Perforations 9 are provided in the areas 8 of the outer shell for the top of the foot, which perforations are intended for shoelaces. The wall thickness of the outer shell is selected to be smaller in this zone than, for example, in the lateral regions of the shank. This makes it possible to bring the shank into close contact with the foot with the aid of the lacing. The lacing engages, by way of the relatively narrow spacing of the perforations, in a good distribution over the entire edge of the opening for the top of the foot, and therefore ensures even with a minor wall thickness a uniformly flush contact of the outer shell in the zone of the top of the foot, with a correspondingly satisfactory pressure distribution.

Figure 4:
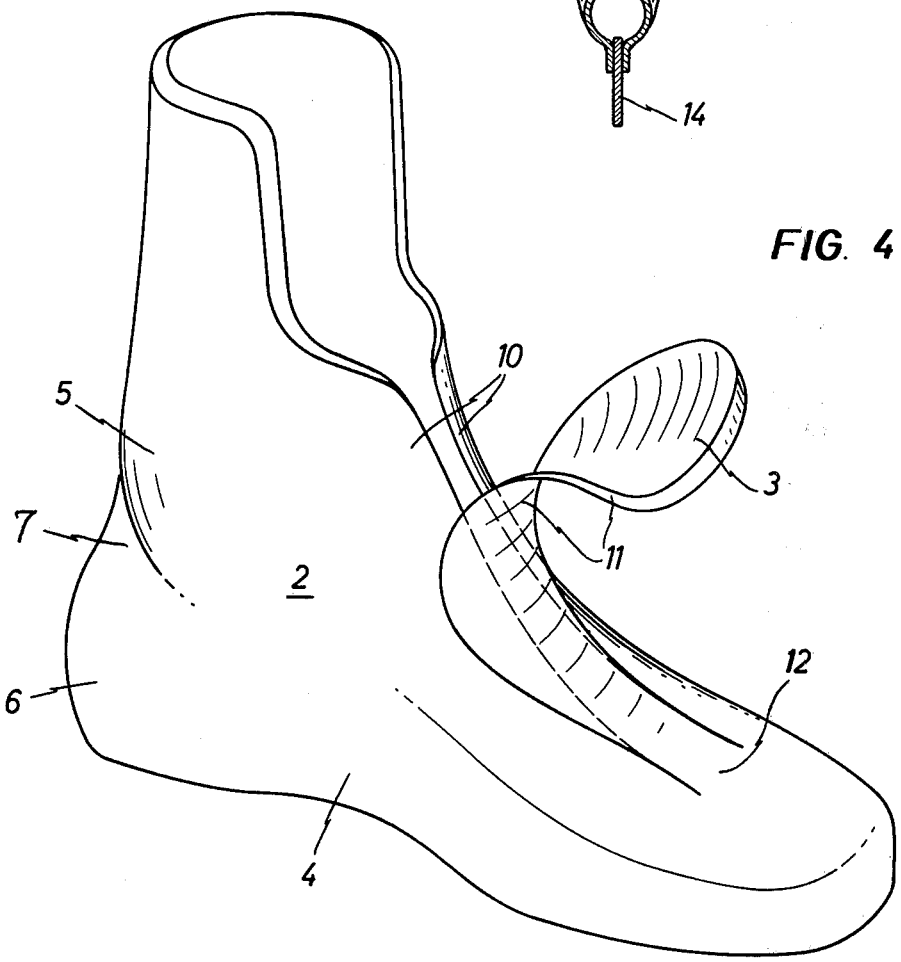
FIG. 4 shows a perspective view of the inner shoe of the preferred embodiment.

As can be seen from FIG. 4, the inner shoe is also fashioned so that it tapers smoothly in its zones 10 around the opening for the top of the foot and along the lateral zones of the tongue 3, to prevent pressure edges, thus promoting a good pressure distribution. The tongue 3 is fashioned to be thicker than the shank wall thickness of the inner shoe 2, in order to absorb the lacing pressure in its zone 11 on top of the foot; in particular, however, the tongue is fashioned to be thicker than the wall thickness in the transition zone 12 between the shank of the inner shoe and the tongue 3 formed integrally therewith. In the in-use condition of the shoe, by the way, the tongue 3 extends laterally over the edge zones 10 for the top of the foot in the inner shoe 2, whereas the tongue extends underneath the zones 8 for the top of the foot in the outer shell 1. Any moisture entering through the opening for the top of the foot in the outer shank and through the perforations 9 in the edge zones for the top of the foot is conducted away via the edge regions of the tongue 3 to the outer surface of the inner shoe shank.

Figure 2:
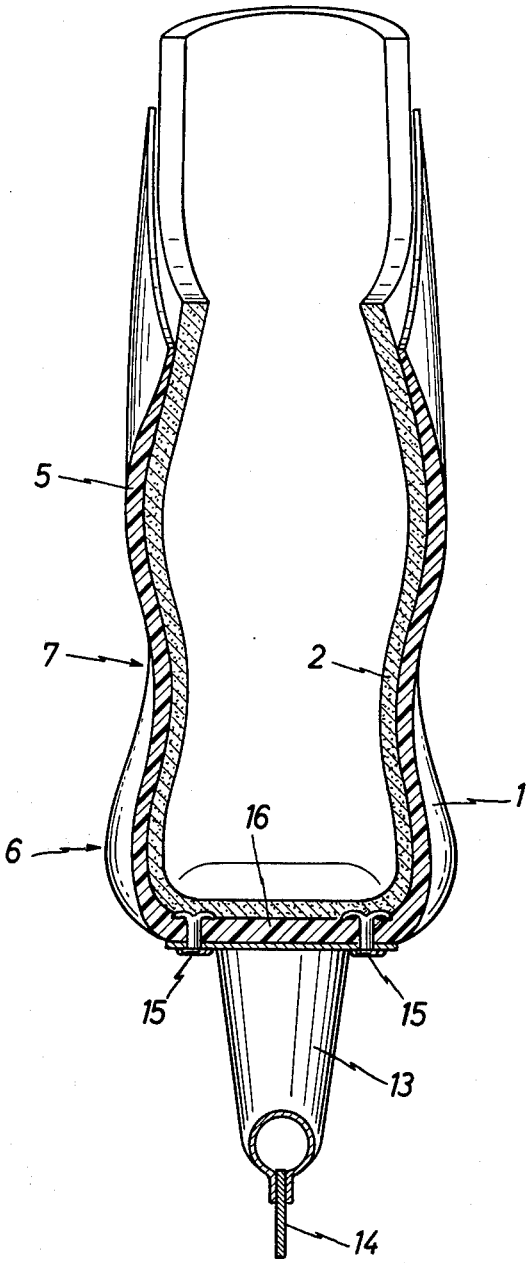
FIG. 2 shows an approximately vertical section along line II—II of FIG. 1.
Figure 3:
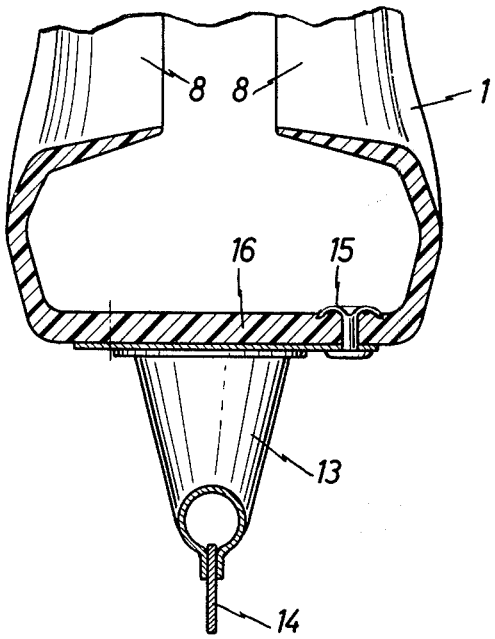
FIG. 3 shows a vertical section along line III—III of FIG. 1, with the inner shoe removed for clarity of presentation.

FIGS. 2 and 3 show that a blade support 13, to which a skate blade 14 is attached, is mounted with the aid of rivet connections 15 directly and exclusively in the sole region 16 of the outer shell 1. The sole region 16 of the outer shell 1 is made to be thicker for this purpose than the remaining laterally adjacent shank portion. Thus, no special means are required, such as insert soles of a specific, reinforced material or the like, to firmly attach the blade support to the outer shell.

As shown particularly in FIG. 2 — which also clearly illustrates the adapted configuration of outer shell and inner shoe in the ankle zone 5, in the heel zone 6, and in the interposed zone of the Achilles tendon — there are no specially projecting or localized thickened portions or thinner zones of the wall of the inner shoe. Rather, the latter has the same wall thickness in its lateral shank region and in the sole area; the inner shoe has only a slightly thickened zone in the upper shank edge region and/or in the edge region for the top of the foot, as likewise shown in a somewhat exaggerated manner in FIG. 2. In a practical embodiment, the wall thickness in the sole zone and in the lower lateral region of the inner shoe is 4.5 mm., while the wall increases in thickness toward the edges to 5 mm. and then again tapers off in the immediate edge zone along the lines of a rounded area and/or smoothly tapers out in the edge zone for the top of the foot. In the region of the Achilles tendon, the wall thickness can be selected to be larger. The outer shell of this embodiment was chosen to be more than 6 mm. in thickness in the sole region, while it was selected to be about three-fourths as thick in the upper zone and in the lateral zone of the front of the shoe. The remaining shank has wall thicknesses of between 4 and 3.5 mm. Of course, this depends to a great extent on the synthetic resins employed in each particular case; deviations are possible.

On the inside of the inner shoe, a fabric is provided which, on the one hand, prevents abrasion of the synthetic resin and, on the other hand, facilitates the insertion of the foot into the shoe; this is not shown in detail. The inner shoe has a foot lining which is merely indicated in priciple in FIG. 2.

I claim:

1. Ice hockey boot with a one piece outer shell of a relatively hard synthetic resin and an inner shoe of a relatively soft synthetic resin and with a blade support mounted to the sole of the outer shell, characterized in that the outer shell is fashioned to be adapted to the shape of the foot in the joint zone, in the ankle zone, in the heel zone, and with respect to the constriction above the heel zone in the Achilles tendon zone.

2. Boot according to claim 1, characterized in that also the inner shoe is fashioned to be adapted to the shape of the foot in the joint zone, in the ankle zone, and in the heel zone, especially with respect to the constriction above the heel zone in the Achilles tendon zone.

3. Boot according to claim 1, characterized in that the outer shell is formed with a wall thickness which decreases toward the top edge zones — especially toward the edge zones of the opening for the top of the foot.

4. Boot according to claim 1, wherein the sole region of the outer shell is reinforced by being thicker than the laterally adjacent shank portion of the outer shell and the blade support is mounted exclusively to the reinforced sole region.

5. Boot according to claim 1, characterized in that the outer shell has perforations for the insertion of shoelaces in the edge zone of the opening for the top of the foot.

6. Boot according to claim 1, characterized in that the outer shell has lateral lacing openings in the impact-protective portion conventionally extended to above the zone of the Achilles tendon.

7. Boot according to claim 1 with a tongue between the outer shell and the inner shoe is formed integrally with the inner shoe and is disposed, in the in-use condition, so that it overlaps the edge zones of the opening for the top of the foot in the inner shoe from the outside.

8. Boot according to claim 7, characterized in that the tongue is fashioned with a larger wall thickness with respect to the transition zone to the shank of the inner shoe in the zone of the top of the foot.

9. Boot according to claim 7, characterized in that the inside of the inner shoe is covered by a fabric.

10. Boot according to claim 8, characterized in that a foot lining is incorporated into the inner shoe.

11. Boot according to claim 1, characterized in that the wall thickness of the sole of the outer shell is larger by about one-fourth than the wall thickness of the adjacent shank portions.

12. Boot according to claim 1, characterized in that the wall thickness of the sole region of the inner shoe is equal to the wall thickness in the adjoining shank portion.

* * * * *